United States Patent [19]

Santhoff

[11] 4,434,921

[45] Mar. 6, 1984

[54] HANDBAG AND BELT CARRIER

[76] Inventor: Rose G. Santhoff, 8144 Jefferson, Kansas City, Mo. 64114

[21] Appl. No.: 330,709

[22] Filed: Dec. 14, 1981

[51] Int. Cl.[3] ..... A45C 11/10

[52] U.S. Cl. ..... 224/253

[58] Field of Search ..... 224/151, 229, 253; 150/35, 37, 39, 47

[56] References Cited

U.S. PATENT DOCUMENTS

| | | | |
|---|---|---|---|
| 1,968,767 | 7/1934 | Howard | 224/253 |
| 2,474,495 | 6/1949 | Pollak | 224/253 X |
| 2,566,569 | 9/1951 | Jensen | 224/253 X |
| 2,983,412 | 5/1961 | Ferguson | 224/253 X |
| 4,174,798 | 11/1979 | Pollard | 224/253 |

*Primary Examiner*—Steven M. Pollard

*Attorney, Agent, or Firm*—Arvid V. Zuber

[57] ABSTRACT

This invention is for a receptacle comprising a combined handbag and belt pouch having concealed support means attached to an inner surface of said receptacle. The support means are adapted to the insertion of a carrying strap and are located at a position, measured from the uppermost portion of said receptacle, which is between one-half and one-quarter of the vertical distance between the uppermost portion of said receptacle and the lowest portion of said receptacle, and, for a method for making such receptacle.

6 Claims, 10 Drawing Figures

HANDBAG AND BELT CARRIER

BACKGROUND OF THE INVENTION

This invention relates to a dual purpose receptacle which may be carried as a handbag or attached to a belt for carrying as a belt pouch.

Handbags are well known and widely used receptacles for carrying personal items such as keys, cash, cosmetics, and the like. However, they must be carried and this effectively immobilizes one hand. Likewise, the bag may be readily detached from a loose grasp and is thus at the mercy of purse-snatchers. It is therefore desirable that a handbag be provided that is capable of the usual and ordinary use but which for safety sake or to free both hands can be securely attached to a belt and carried or worn in that position.

It is known to make pouches or purses which may be worn on a belt. For example, U.S. Pat. No. 2,474,495 to H. Pollak discloses a purse adapted to be worn on a belt. Additionally, U.S. Pat. No. 3,158,300 to K. C. Withee discloses a pouch which is made or adapted to be worn on a belt. Neither patent discloses a handbag which may be used as a belt pouch as well as carried as a handbag.

Therefore, it is an object of this invention to provide a handbag which may also be worn or securely attached to a belt.

It is a further object of this invention to provide a method of making a handbag which may also be worn as a belt pouch.

DESCRIPTION OF THE INVENTION

This invention relates to a receptacle comprising a combined handbag and belt pouch and to a method for making such a receptacle.

More particularly this invention relates to a receptacle comprising a combined handbag and belt pouch having concealed support means attached to an inner surface of said receptacle, said support means being adapted to the insertion of a carrying strap and being located at a position, measured from the uppermost portion of said receptacle which is between one-half and one-quarter of the vertical distance between the uppermost portion of said receptacle and the lowest portion of said receptacle.

This invention also provides a method of making a combined handbag and belt pouch which comprises forming identically shaped back and front pieces from sheet material having an inner surface and outer surface, each of said pieces having a bottom edge and a closure edge located in identical positions on the upper portion of each piece; attaching support means adapted to insertion of a carrying strap to the inner surface of at least one of the pieces, said support means comprising at least two loop openings positioned at the edges of the piece to which it is attached and being positioned below the closure edge along a line located at an angle of approximately 90° relative to a line drawn vertically upward from the lowest portion of the bottom edge and at a distance from the uppermost portion of the closure edge of between one-quarter and one-half of the vertical distance from the uppermost portion of the closure edge to the lowest portion of the bottom edge; placing the front piece over the back piece with the outer surfaces of each piece exposed; fastening the edges of the front piece and the back piece together leaving the closure edges open and providing access to the loop openings of the support means; and, attaching closure means to said closure edges.

The invention is now explained with respect to the drawings.

Figure 1:
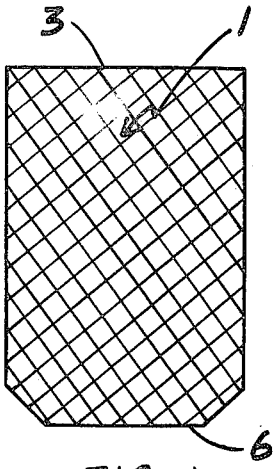
FIG. 1 illustrates one of two identically shaped pieces of material viewed towards the outer surface of the material.

FIG. 1 is a view of the outer surface of one of two identically shaped pieces of material, 1, having a bottom edge 6 and a closure edge 3.

Figure 2:
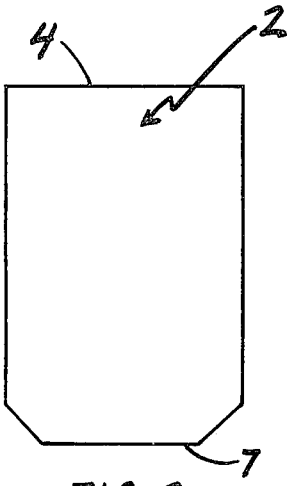
FIG. 2 shows the second of two identically shaped pieces of material viewed towards the inner surface.

FIG. 2, is a view of the inner surface of a piece of material, 2, identical to the piece of material, 1, in FIG. 1 with a bottom edge, 7, and a closure edge, 4.

Figure 3:
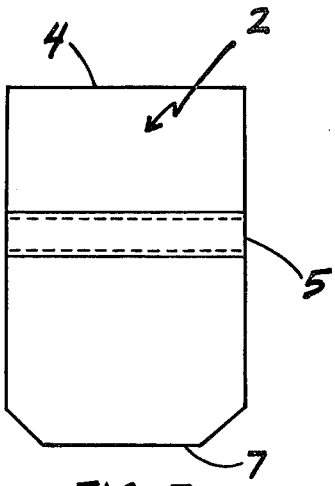
FIG. 3 shows the same view as in FIG. 2 of the inner surface of the second identically shaped piece of material with a strip, 5, attached to the piece to form a continuous loop across the piece.

FIG. 3 is a view of the sheet of material of FIG. 2 with a strip of material, 5, attached to the sheet to provide a continuous loop for support means across the width of the sheet.

Figure 4:
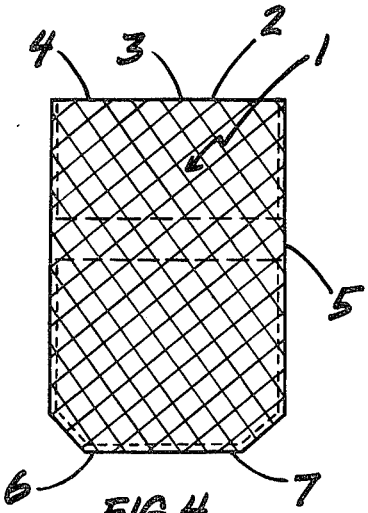
FIG. 4 is a view of the piece of material of FIG. 1 placed on top of the piece of material of FIG. 3 and fixed together.

In FIG. 4 the piece of material of FIG. 1 has been placed on top of the material provided with support means as shown in FIG. 3 and fixed together at the edges leaving the closure edges, 3, and, 4, open and leaving access to the support means, 5.

Figure 5:
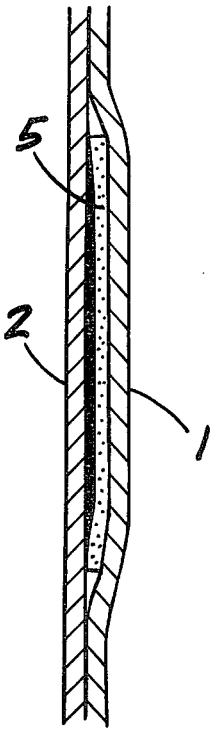
FIG. 5 is a cross-sectional view of the portion of FIG. 4 which contains the support loop 5.
Figure 7:
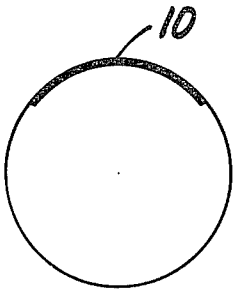
FIGS. 7 through 10 illustrate a few of the many shapes which may be utilized to make the receptacles of this invention.
Figure 8:
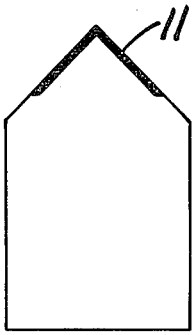
Figure 9:
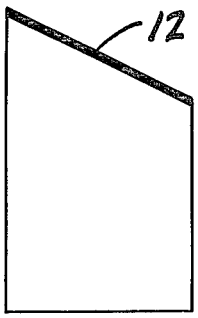
Figure 10:
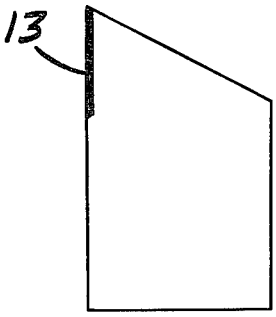

FIG. 5 shows a sideview of the portion of FIG. 7 wherein the support means may be viewed through a side opening provided in the two pieces of material fastened together.

Figure 6:
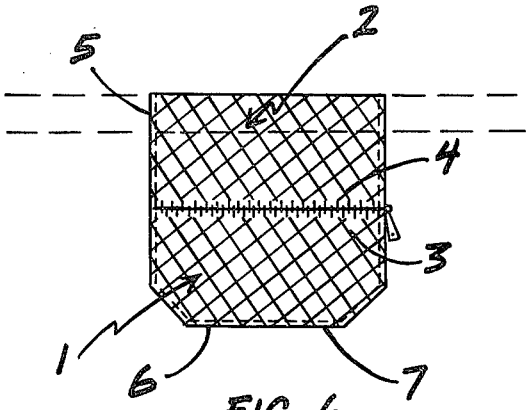
FIG. 6 depicts the receptacle in the configuration in which it is intended to be worn or carried.

FIG. 6 shows the finished article with closure means applied to the closure edges and folded over the support means in the configuration in which the article is intended to be worn or carried. In FIG. 6 the dotted lines represent a belt or carrying strap which has been passed through the support means 5 to provide a means of carrying or wearing the receptacle.

FIGS. 7 through 10 are illustrative of the many shapes which the pieces of material used to make the receptacles can take. These FIGURES also illustrate the manner in which the various closure edges, 10, 11, 12, and 13, may be chosen as all or part of an edge of the pieces of material of which the receptacles are made. As may readily be understood from FIGS. 7 through 10 all or part of any upper edge so long as it will provide access to the finished receptacle may be chosen as the closure edge.

It is will also be understood that either side of a sheet of material may be chosen as the inner surface or the outer surface. Likewise, if the surfaces of the sheet be identical either of the two may be designated as an inner surface or as an outer surface. Neither is it necessary that the two pieces be made from identical sheets of material. It will also be understood that the pieces may be joined along any edge which does not interfere with the construction of the receptacle.

The support means may be any loop or loops which are sufficient to support the bag when suspended from a belt or carrying strap. In order that the interior of the bag have an essentially smooth surface and to avoid interference of the belt or carrying strap with access to the bag and its contents, it is preferred that the support means be a continuous strip such as illustrated by strip, 5, in FIG. 3. To avoid wear on the seams of the receptacle it is essential that the support means comprise at least two loops positioned at the edges of the receptacle. These may be the loops in the end of a continuous strip such as that described above or the loops provided by two belt loops positioned at opposite edges of the receptacles. As will be understood additional loops may be provided as may be necessary to support the receptacle.

Although any type of closure means which will provide a secure fastening for the receptacle may be used, closures of the type commonly called zippers are preferred.

What is claimed is:

1. A receptacle comprising a combined handbag and belt pouch having concealed support means attached to an inner surface and located within said receptacle, said support means being adapted to the insertion of a carrying strap and being located at a position, measured from the uppermost portion of said receptacle, which is between one-half and one-quarter of the vertical distance between the uppermost portion of said receptacle and the lowest portion of said receptacle.

2. A receptacle according to claim 1 wherein said support means comprise at least two loops, two of which are positioned at the edges of the receptacle.

3. A receptacle according to claim 1 wherein said supports means comprise a continuous strip of material open at both ends of the strip.

4. The method of making a combined handbag and belt pouch receptacle which comprises forming identically shaped back and front pieces from sheet material having an inner surface and outer surface, each of said pieces having a bottom edge and a closure edge located in identical positions on the upper portion of each piece; attaching support means adapted to insertion of a carrying strap to the inner surface of at least one of the pieces such that the support means will be located within the receptacle, said support means comprising at least two loop openings positioned at the edges of the piece to which it is attached and being positioned below the closure edge along a line located at an angle of approximately 90° relative to a line drawn vertically upward from the lowest portion of the bottom edge and at a distance from the uppermost portion of the closure edge of between one-quarter and one-half of the vertical distance from the uppermost portion of the closure edge to the lowest portion of the bottom edge; placing the front piece over the back piece with the outer surfaces of each piece exposed; fastening the edges of the front piece and the back piece together leaving the closure edges open and providing access to the loop openings of the support means; and, attaching closure means to said closure edges.

5. The method of claim 4 wherein the support means comprise at least two loops, two of which are positioned at the edges of the receptacle.

6. The method of claim 4 wherein the support means comprises a continuous strip of material.

* * * * *